US006666732B1

(12) United States Patent
Endacott

(10) Patent No.: US 6,666,732 B1
(45) Date of Patent: Dec. 23, 2003

(54) TERMINAL CONNECTOR

(76) Inventor: John E. Endacott, 55 Star Lake Dr., Pensacola, FL (US) 32507

( * ) Notice: Subject to any disclaimer, the term of this patent is extended or adjusted under 35 U.S.C. 154(b) by 233 days.

(21) Appl. No.: 09/860,338

(22) Filed: May 21, 2001

(51) Int. Cl.[7] ..... H01R 4/02
(52) U.S. Cl. ..... 439/874; 439/730; 439/932
(58) Field of Search ..... 439/874, 932; 29/859, 860

(56) References Cited

U.S. PATENT DOCUMENTS

| | | | | | |
|---|---|---|---|---|---|
| 2,655,641 | A | * | 10/1953 | Asaff | 439/874 |
| 3,305,625 | A | * | 2/1967 | Ellis | 174/84 R |
| 3,525,799 | A | * | 8/1970 | Ellis | 174/84 R |
| 3,601,783 | A | * | 8/1971 | Loose | 439/730 |
| 4,144,404 | A | | 3/1979 | De Groef et al. | |
| 4,176,244 | A | * | 11/1979 | Ramy et al. | 174/88 C |
| 4,206,786 | A | | 6/1980 | Wetmore | |
| RE30,447 | E | | 12/1980 | Loyd et al. | |
| 4,341,921 | A | | 7/1982 | Simpson | |
| 4,346,145 | A | | 8/1982 | Choi et al. | |
| 4,576,871 | A | | 3/1986 | Oestreich | |
| 4,849,580 | A | | 7/1989 | Reuter | |
| 4,863,535 | A | | 9/1989 | More | |
| 4,881,995 | A | | 11/1989 | Arenz | |
| 4,883,925 | A | | 11/1989 | Graf | |
| 4,894,030 | A | * | 1/1990 | Chavaroux | 439/874 |
| 4,910,090 | A | | 3/1990 | Kuhlman et al. | |
| 4,940,179 | A | | 7/1990 | Soni | |
| 4,993,149 | A | | 2/1991 | Zilligen et al. | |
| 5,137,478 | A | | 8/1992 | Graf et al. | |
| 5,221,815 | A | | 6/1993 | Bostock et al. | |
| 5,278,354 | A | * | 1/1994 | Lhomme | 174/84 R |
| 5,369,225 | A | | 11/1994 | Natwig et al. | |
| 5,393,932 | A | | 2/1995 | Young et al. | |
| 5,418,331 | A | | 5/1995 | Delalle | |
| 5,514,836 | A | | 5/1996 | Delalle et al. | |
| 5,527,612 | A | | 6/1996 | Ohta et al. | |

* cited by examiner

*Primary Examiner*—Neil Abrams
*Assistant Examiner*—Phuong Dinh
(74) *Attorney, Agent, or Firm*—Peter Loffler

(57) ABSTRACT

A terminal connector mechanically and electrically binds a wire with a terminal fixture in a high reliability manner. The terminal fixture is mechanically and electrically connected to a crimpable barrel. A solder sleeve is positioned in abutting relation with the barrel while heat shrinkable tubing is positioned so as to encompass the solder sleeve and at least a portion of the barrel. A wire is inserted through the tubing, the solder sleeve and is received within the barrel. The barrel is crimped and the device is heated so as to melt the solder sleeve and the tubing.

22 Claims, 2 Drawing Sheets

TERMINAL CONNECTOR

BACKGROUND OF THE INVENTION

1. Field of the Invention

The present invention relates to terminal connector wherein he wire is secured to the terminal fixture by crimping and by soldering.

2. Background of the Prior Art

In connecting a wire to a terminal fixture, such as a ring, spade, a male connector, a female connector, etc., a strong mechanical as well as electrical connection is desired. In order to achieve these goals, many prior art devices have been proposed that connect a wire with a terminal fixture. While such prior art devices work with varying degrees of efficiency, such devices suffer from one or more drawbacks. Many terminal fixture connection devices are relatively complex in construction making these devices relatively expensive to manufacture and difficult to use. Some devices provide a relatively weak electrical connection that can fail over time. Some devices, although providing a sufficiently strong electrical connection, provide a relatively weak mechanical connection that can fail over time resulting in failure of the electrical connection.

Therefore, there exists a need in the art for a device that mechanically and electrically connects a wire to a terminal fixture wherein both the mechanical connection and the electrical connection are sound and wherein the connection tends not to fail unreasonably over time. Such a device must be of relatively simple design and construction and must be relatively easy to install and maintain.

SUMMARY OF THE INVENTION

The terminal connector of the present invention addresses the aforementioned needs in the art. The terminal connector mechanically and electrically connects a wire to a terminal fixture wherein both the mechanical connection and the electrical connection are sound and wherein the connection tends not to fail unreasonably over time. The device is of relatively simple design and construction and is relatively easy to install and maintain.

The terminal connector of the present invention is comprised of a terminal fixture having a crimpable barrel mechanically and electrically connected thereto. A solder sleeve is provided and abuts the crimpable barrel. A heat shrinkable tubing is provided and is positioned such that the tubing encompasses the solder sleeve and a portion of the barrel. The barrel is adapted to receive a wire and the barrel is crimped thereonto to mechanically and electrically bind the barrel with the wire. Thereafter, the solder sleeve is melted to further mechanically and electrically bind the barrel and the wire and the tubing is heated to encapsulate around the wire and the barrel. The tubing, which acts as an insulator, has an outer surface as well as an inner surface that has an adhesive layer upon the inner surface wherein upon heating the tubing the adhesive layer melts and adhesively binds the terminal fixture, the solder sleeve, the tubing and a portion of insulation encompassing a portion of the wire. The adhesive layer is heat activated and can be co-extruded with the tubing. The terminal fixture can be any appropriate fixture such as a ring, a spade, a male connector, a female connector, etc. The solder sleeve can be a low temperature solder member and can be pre-fluxed.

BRIEF DESCRIPTION OF THE DRAWINGS

Similar reference numerals refer to similar parts throughout the several views of the drawings.

DESCRIPTION OF THE PREFERRED EMBODIMENT

Figure 1:
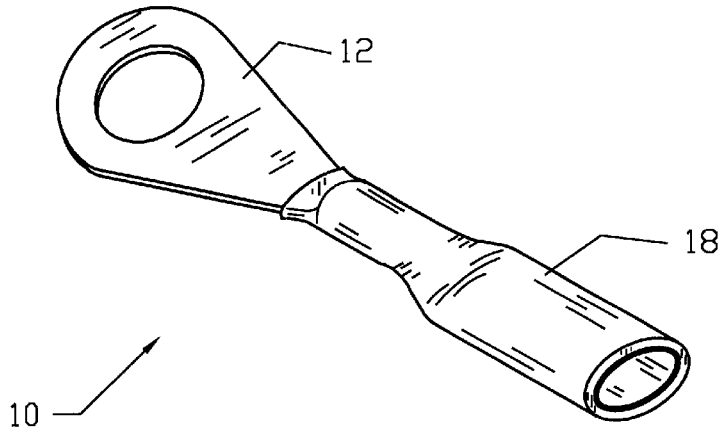
FIG. 1 is a perspective view of the terminal connector of the present invention.
Figure 2:
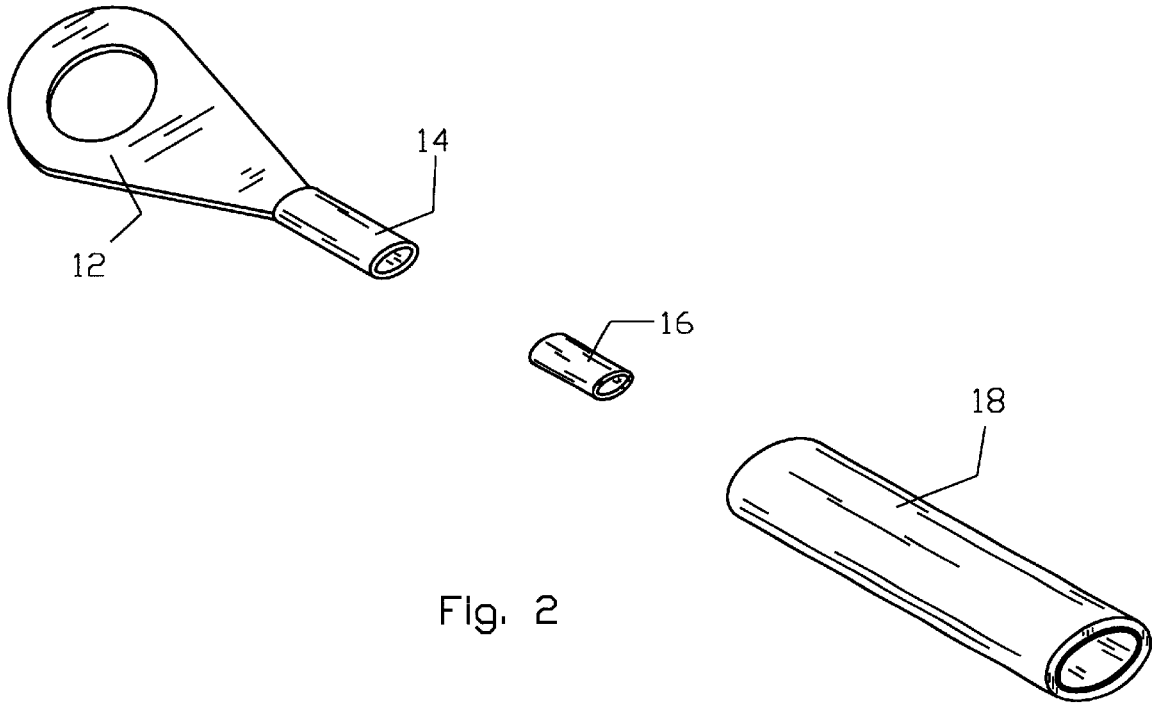
FIG. 2 is an exploded view of the terminal connector.
Figure 3:
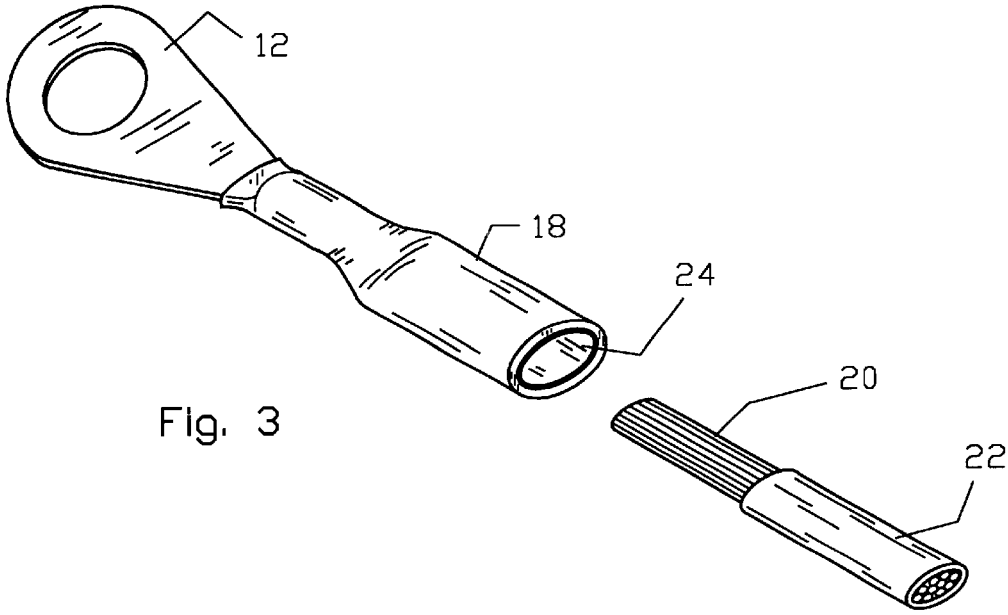
FIG. 3 is an environmental view of the terminal connector about to receive a wire.
Figure 4:
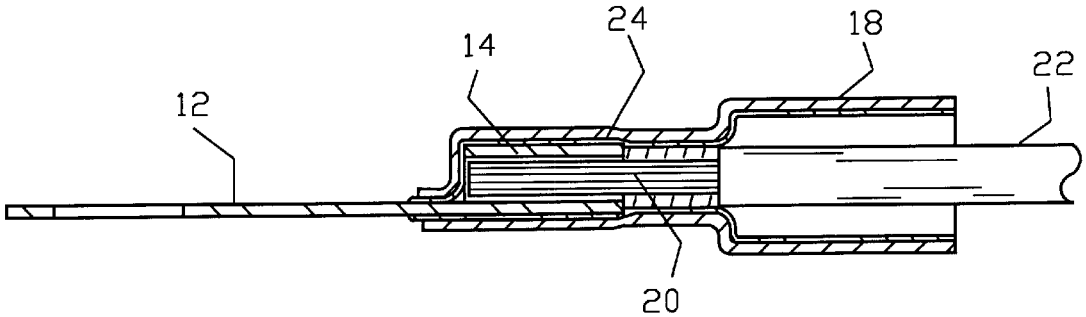
FIG. 4 is a side sectioned view of the terminal connector after receiving a wire.
Figure 5:
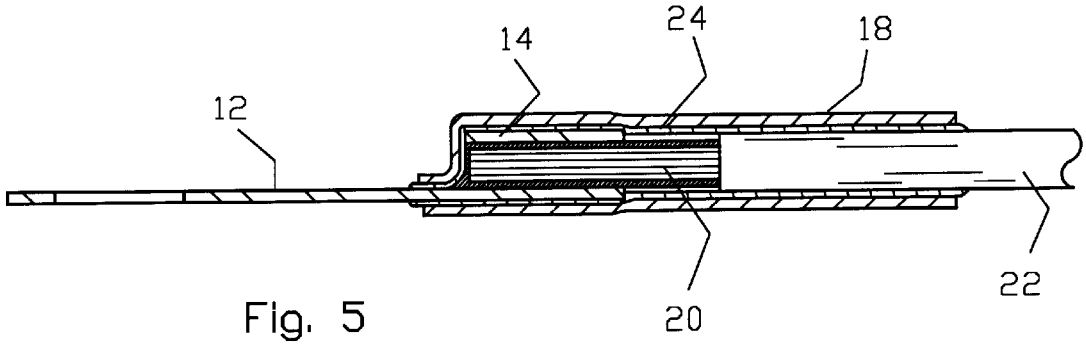
FIG. 5 is a side sectioned view of the terminal connector bound to the wire.

Referring now to the drawings, it is seen that the terminal connector, generally denoted by reference numeral 10, is comprised of a terminal fixture 12 having a crimpable barrel 14 mechanically and electrically connected thereto in any appropriate fashion known in the art. The terminal fixture 12 can be any appropriate fixture such as the illustrated ring, a spade, a male connector, a female connector, etc. A solder sleeve 16 is provided and is positioned so that the solder sleeve 16 abuts the crimpable barrel 14. The solder sleeve 16 is a tubular member and is a low temperature solder member, a low temperature solder member being defined as a solder member that melts at a temperature no greater than about 300 degrees Fahrenheit at sea level under normal atmospheric conditions. By using a low temperature solder sleeve 16, the need for special heating devices for melting the solder sleeve 16 is eliminated. The solder sleeve 16 is also a pre-fluxed solder member, the pre-fluxed nature of the solder sleeve 16 providing a cleansing agent to clean the various metal surfaces.

A heat shrinkable tubing 18, which is a hollow tubular member, is provided and is positioned such that the tubing 18 encompasses the solder sleeve 16 and at least a portion of the barrel 14. The tubing 18 is made from an appropriate heat shrinkable material, such as polyolefin, and has a heat shrink ratio of at least about 2 to 1. The tubing 18 may be at least partially translucent so that the connection of the terminal fixture 12 with the wire 20 can be seen and the tubing 18 may be tinted and may also have certain identification indicia printed thereon. An adhesive layer 24 is located on the inner surface of the tubing 18. The adhesive layer 24 is heat activated and can be co-extruded with the tubing 18.

A wire 20 having its insulation 22 removed from an end thereof is passed through the tubing 18, through the solder sleeve 16, and is received within the barrel 14. Once so received, the barrel 14 is crimped in appropriate fashion in order to crimp the barrel 14 onto the exposed end of the wire 20. This provides a mechanical and electrical connection of the barrel 14, and this the terminal fixture 12, with the wire 20.

Thereafter, the tubing 18 and the solder sleeve 16 held therein are heated causing the solder sleeve 16 to melt and flow into the deformed areas of the crimped barrel 14 and wire 20. This adds an additional layer of mechanical and electrical binding of the wire 20 with the terminal fixture 12. Additionally, the tubing 18, by being heated, encapsulates the barrel 14 and the wire 20 held therein. Additionally, the adhesive layer 24 melts and adhesively binds the terminal fixture 12, the tubing 18, the wire 20, and a portion of the insulation member 22.

While the invention has been particularly shown and described with reference to an embodiment thereof, it will be appreciated by those skilled in the art that various changes in form and detail may be made without departing from the spirit and scope of the invention.

I claim:

1. A terminal connector comprising:

a terminal fixture;

a crimpable barrel mechanically and electrically connected to the terminal fixture;

a separate solder sleeve that abuts the terminal barrel;

a heat shrinkable tubing positioned such that the tubing encompasses the solder sleeve and a portion of the barrel; and wherein the barrel is adapted to receive a wire; the wire passing through the solder sleeve and then through the crimpable barrel, and the barrel is crimped thereonto to mechanically and electrically bind the barrel with the wire, and the solder sleeve is melted to further mechanically and electrically bind the barrel and the wire and the tubing is heated to encapsulate the wire and the barrel.

2. The terminal connector as in claim 1 wherein the tubing has an inner surface having an adhesive material wherein upon heating the tubing the adhesive material binds the terminal fixture, the solder sleeve, the tubing and a portion of an insulation member encompassing a portion of the wire.

3. The wire connector as in claim 2 wherein the adhesive material is heat activated.

4. The wire connector as in claim 2 wherein the adhesive material is co-extruded with the hollow sleeve.

5. The terminal connector as in claim 1 wherein the terminal fixture is a ring.

6. The terminal connector as in claim 1 wherein the terminal fixture is a spade.

7. The terminal connector as in claim 1 wherein the terminal fixture is a male connector.

8. The terminal connector as in claim 1 wherein the terminal fixture is a female connector.

9. The terminal connector as in claim 1 wherein the terminal fixture is selected from the group consisting of a ring, a spade, a male connector, and a female connector.

10. The wire connector as in claim 1 wherein the solder sleeve is a low temperature solder member.

11. The wire connector as in claim 1 wherein the solder sleeve is pre-fluxed.

12. A method of mechanically and electrically connecting a wire with a terminal fixture comprising the steps of:

providing the terminal fixture;

providing a crimpable barrel and mechanically and electrically connecting the barrel to the terminal fixture;

providing a separate solder sleeve and abutting the solder sleeve against the crimpable barrel;

providing a heat shrinkable tubing positioning the tubing such that the tubing encompasses the solder sleeve and a portion of the barrel;

having the barrel receive the wire, such that the wire passes through the solder sleeve and then into the barrel, and crimping the barrel onto the wire; and heating the solder sleeve and the tubing.

13. The method as in claim 12 wherein the tubing has an inner surface having an adhesive material thereon wherein upon heating the tubing, the adhesive flow adhesively binds the terminal fixture, the solder sleeve, the tubing and a portion of an insulation member encompassing a portion of the wire.

14. The method as in claim 13 wherein the adhesive material is heat activated.

15. The method as in claim 13 wherein the adhesive material is co-extruded with the hollow sleeve.

16. The terminal connector as in claim 12 wherein the terminal fixture is a ring.

17. The terminal connector as in claim 12 wherein the terminal fixture is a spade.

18. The terminal connector as in claim 12 wherein the terminal fixture is a male Connector.

19. The terminal connector as in claim 12 wherein the terminal fixture is a female connector.

20. The terminal connector as in claim 12 wherein the terminal fixture is selected from the group consisting of a ring, a spade, a male connector, and a female connector.

21. The method as in claim 12 wherein the solder sleeve is a low temperature solder member.

22. The method as in claim 12 wherein the solder sleeve is pre-fluxed.

* * * * *